US007287285B2

(12) United States Patent
Jaeger et al.

(10) Patent No.: US 7,287,285 B2
(45) **Date of Patent: *Oct. 30, 2007**

(54) GLOVE CONSTRUCTION WHEREIN PALM MATERIAL ROLLS OVER FINGERTIP

(76) Inventors: Eric M. Jaeger, 425 20th St., Manhattan Beach, CA (US) 90266; Eduard A. Jaeger, 443 Concord St., El Segundo, CA (US) 90245

( * ) Notice: Subject to any disclaimer, the term of this patent is extended or adjusted under 35 U.S.C. 154(b) by 23 days.

This patent is subject to a terminal disclaimer.

(21) Appl. No.: 10/459,774

(22) Filed: Jun. 13, 2003

(65) Prior Publication Data

US 2004/0250335 A1 Dec. 16, 2004

(51) Int. Cl.
*A41D 19/00* (2006.01)

(52) U.S. Cl. ..... 2/161.1; 2/16

(58) Field of Classification Search ..... 2/161.6, 2/163, 161.1, 169, 16, 20
See application file for complete search history.

(56) References Cited

U.S. PATENT DOCUMENTS 133,376 A * 11/1872 Mason ..... 2/169
745,088 A * 11/1903 Winkler ..... 2/163
1,239,255 A * 9/1917 Burroughs ..... 2/163
1,377,338 A * 5/1921 Grinnell ..... 2/169
2,018,442 A * 10/1935 Elkus ..... 2/161.6
2,295,507 A * 9/1942 Wells, Jr. et al. ..... 2/161.6
2,632,171 A * 3/1953 Kuh ..... 2/161.6
4,858,245 A * 8/1989 Sullivan et al. ..... 2/21
5,231,700 A * 8/1993 Cutshall ..... 2/161.7
5,774,897 A * 7/1998 Hochmuth ..... 2/161.1
7,100,212 B2 * 9/2006 Jaeger ..... 2/161.1
2004/0025226 A1 * 2/2004 Jaeger ..... 2/161.6
2004/0025227 A1 * 2/2004 Jaeger ..... 2/161.6

OTHER PUBLICATIONS www.iclad.com-assignee and inventor's website.*

* cited by examiner

*Primary Examiner*—Katherine Moran

(57) ABSTRACT

A glove structure that incorporates a palm piece having a portion that rolls over the fingertips and is sewn to the top portion of the back piece thus eliminating the conventional thick seam lines on the fingertips and resulting in a smooth seam of material over the entire fingertip and a substantial increase in finger tactility. The palm material narrows as it rolls over the fingertip and preferably has the shape of an hourglass.

3 Claims, 5 Drawing Sheets

FIG. 3
PRIOR ART
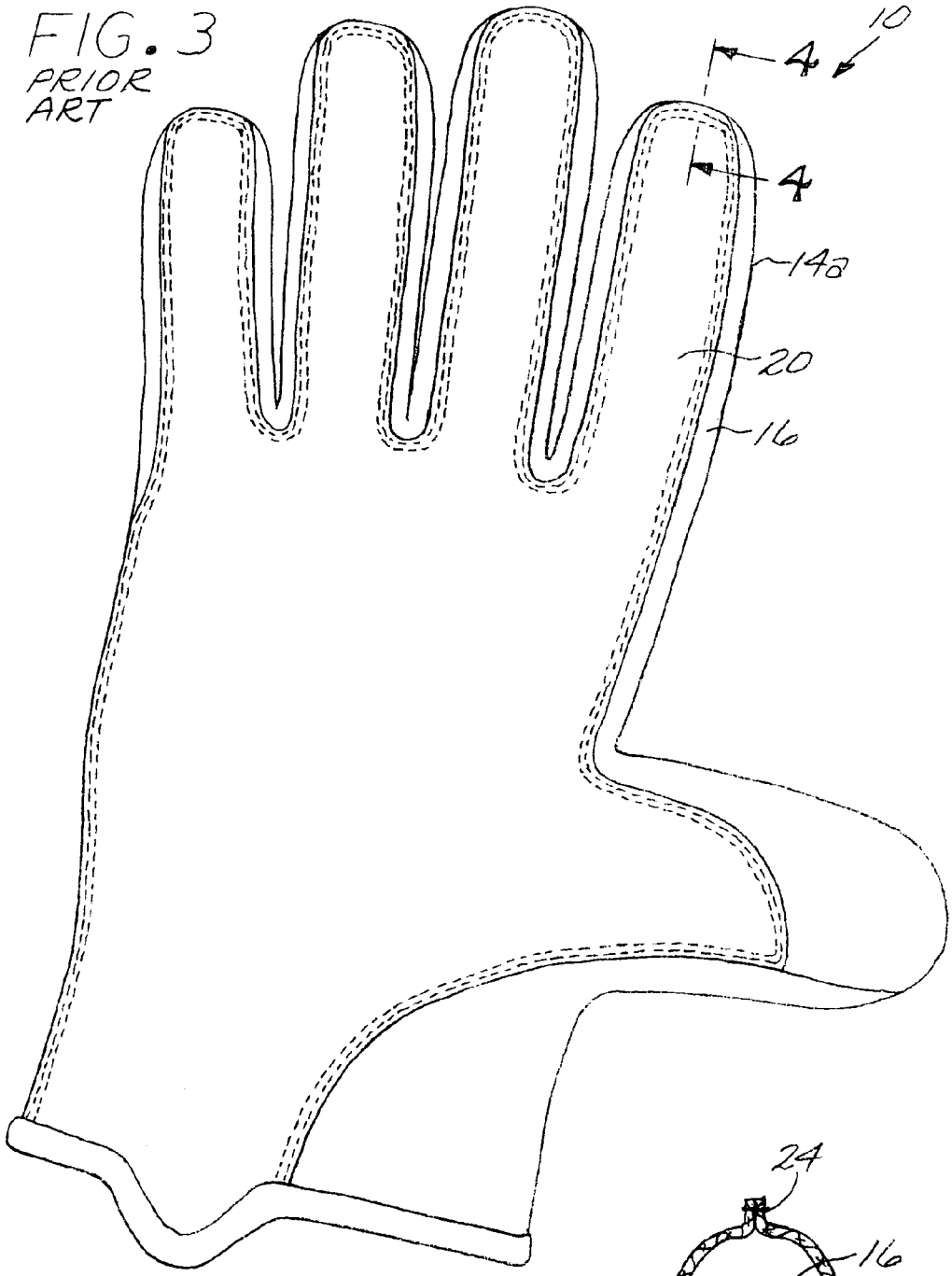
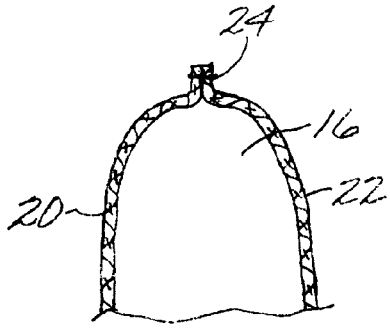
FIG. 4
PRIOR ART

GLOVE CONSTRUCTION WHEREIN PALM MATERIAL ROLLS OVER FINGERTIP

BACKGROUND OF THE INVENTION

1. Field of the Invention

The present invention provides an improved glove construction wherein the palm material has a portion which rolls over the fingertips.

2. Description of the Prior Art

Gloves specifically designed for use in the construction industry have been available in the prior art. For example, Ironclad Performance Wear Corp., Los Angeles, California., sells a variety of gloves having a palm piece attached to a back piece through the use of fourchettes. The glove fingers are attached to the palm and back pieces across the tips of the fingers, down the side of each finger and down through the crotch between each finger. The Ironclad gloves typically have a pattern on the palm piece to protect the user hand from strain, vibration or abrasion.

U.S. Pat. No. 5,490,290 to Gold discloses a glove structure wherein the palm piece is attached to the back piece through the use of connector strips made from stretchable elastic fabric, such as spandex.

The problems with the conventional glove design is that sensitivity is reduced as the typical glove has materials (4) coming together at one point; wearer fingernails tend to hang up on seams reducing the utility and mobility when the gloves are worn; seams in the central wear area cause the glove material wearing out; the presence of multiple materials and seams reduces wear comfort; the plural seams and materials increases the likelihood that the glove will snag on outside items such as nails and screws; and the fingernails are susceptible to damage because of the thin and lighter palm material used in conventional gloves.

Ski gloves have been available which include an inner glove portion and an outer shell glove portion which includes a palm design that wraps up and over the fingertips. This ski glove construction is not a single, fitted glove, is primarily limited to skiing and other winter sport activities and is not designed to be long lived.

The glove construction disclosed in co-pending application Ser. No. 10/215,946, filed on Aug. 10, 2002 and assigned to the assignee of the instant application overcomes the above noted disadvantages by providing a fitted glove structure that incorporates a palm piece having a molded rubber palm pattern, the palm pattern including a portion which rolls over to the back piece in a manner that increases fingertip sensitivity, increases the mobility and efficiency of the wearer, increases glove lifetime, increases wearer comfort and increases fingernail protection. The palm piece and back piece on the second, third and fourth finger are joined by fourchettes and the palm pattern is made of heat pressable rubber. A portion of the molded rubber palm pattern extends over the fingertips (except the thumb) and is sewn to the stretch nylon on the top portion of the back piece.

The glove described in the aforementioned '946 application provides a significant advance in the construction of gloves. Although the inventive concept disclosed therein is directed to fingertip roll over of the molded rubber palm pattern, it has now been recognized that the same glove construction advantage could also be adapted to the palm material itself, without the inclusion of the molded rubber palm pattern.

SUMMARY OF THE INVENTION

The present invention provides a glove structure that incorporates a palm piece having a portion that rolls over the fingertips and is sewn to the top portion of the back piece.

The palm pattern with the roll over fingertip portion is unique in work gloves and sport gloves by eliminating the thick seam lines on the fingertips and resulting in a smooth seam of material over the entire fingertip and a substantial increase in finger tactility. This increase in tactility provides a glove that is more comfortable and more functional than available in the prior art. A user can pick up small objects such as coins, nails, screws, buttons, etc, and will also have a heightened awareness of the contact environment—smooth vs. rough, for example Since the palm material rolls over the distal end of the finger (i.e. the fingertip), there is no horizontal seam at the fingertip, the palm material being secured to the glove back and not at the fingertip. The palm material narrows as it rolls over the fingertip and preferably, has the shape is that of an hourglass. This narrowed shape enables the fourchettes at the finger sides to be more rounded in shape, the glove fingers in turn tapering at the tip, thus providing a shape that fits the user's hands in a more natural manner.

The present invention thus provides a fitted glove configuration that increases wearer comfort and enables various types of objects to be grasped by the user while increasing glove lifetime.

DESCRIPTION OF THE DRAWINGS

For a better understanding of the present invention as well as other objects and further features thereof, reference is made to the following description which is to be read in conjunction with the accompanying drawing therein:

FIG. 3 is a view of the glove configuration shown in FIG. 1 turned inside out;

FIG. 4 is a sectional view along line 4-4 of FIG. 3;

DESCRIPTION OF THE INVENTION

Figure 1:
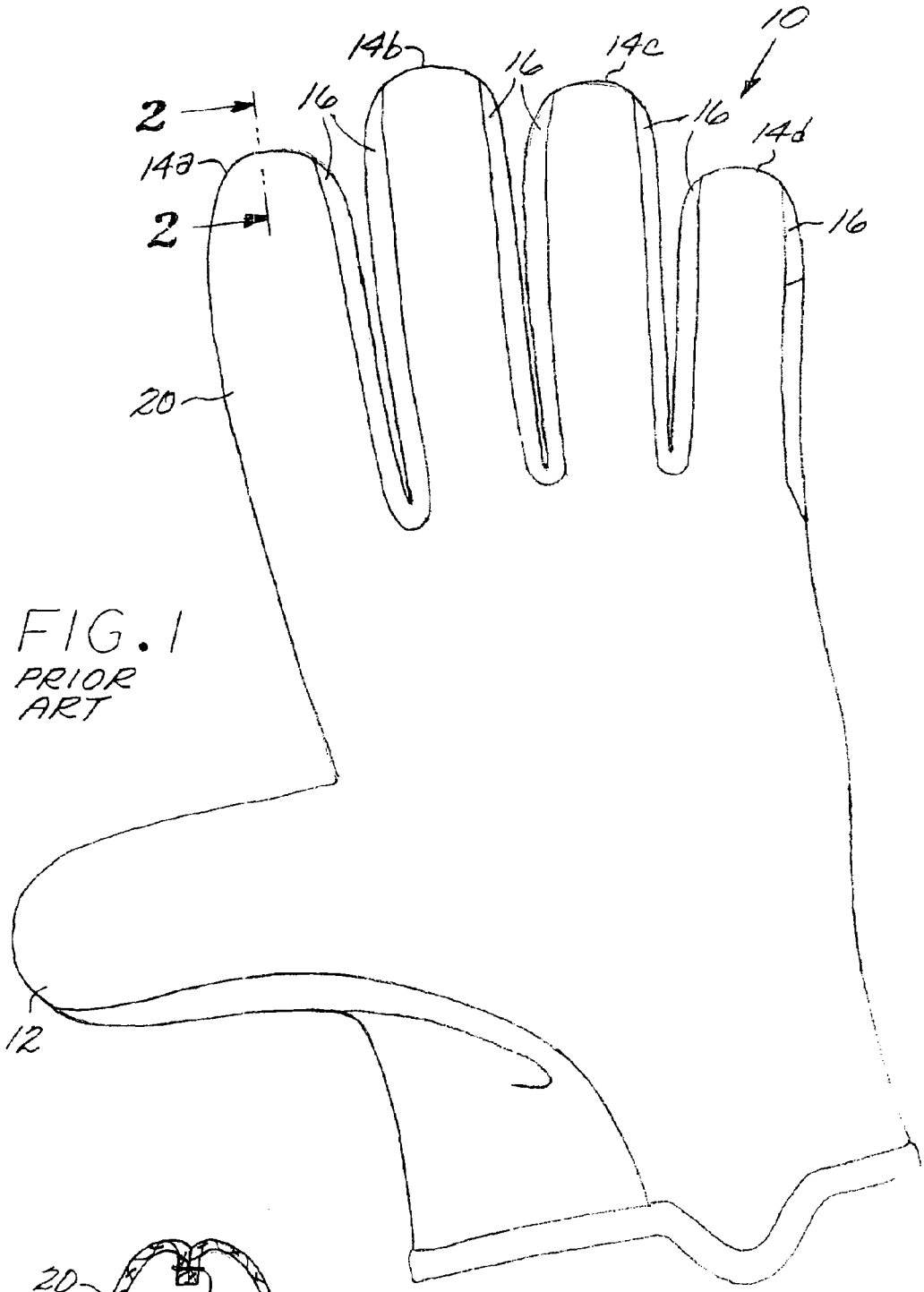
FIG. 1 PRIOR ART
FIG. 1 is a view of the palm portion of a glove configuration of the prior art.
Figure 2:
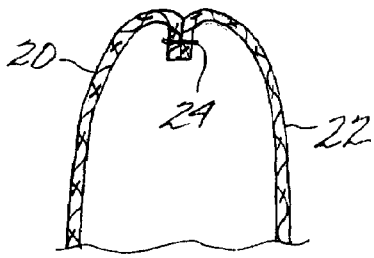
FIG. 2 PRIOR ART
FIG. 2 is a sectional view along line 2-2 of FIG. 1.

Referring now to FIGS. 1 and 2, a view of a typical prior art palm piece glove construction 10 is illustrated. Palm piece 10 has a thumb portion 12 and finger portions 14*a*, 14*b*, 14*c* and 14*d* and a corresponding back piece 22. Since the concept of the present invention is related to the specific construction of the glove fingertips, the discussion that follows will be directed to that portion of the glove construction. As illustrated, fourchettes 16 are typically provided on the sides of the index finger 14*a*, index finger 14*b*, ring finger 14*c*, and the little finger or pinkie, 14*d*; the palm material 20 and the back piece spandex type material 22 are sewn together by stitching 24 as shown in FIG. 2, forming a horizontal seam at the top of the fingertip that will cause discomfort to the glove wearer.

FIGS. 3 and 4 illustrate the glove construction of FIG. 1 turned inside-out and shows palm material 20, back spandex type material 22, and fourchettes 16 sewn together by stitching 24.

Figure 5:
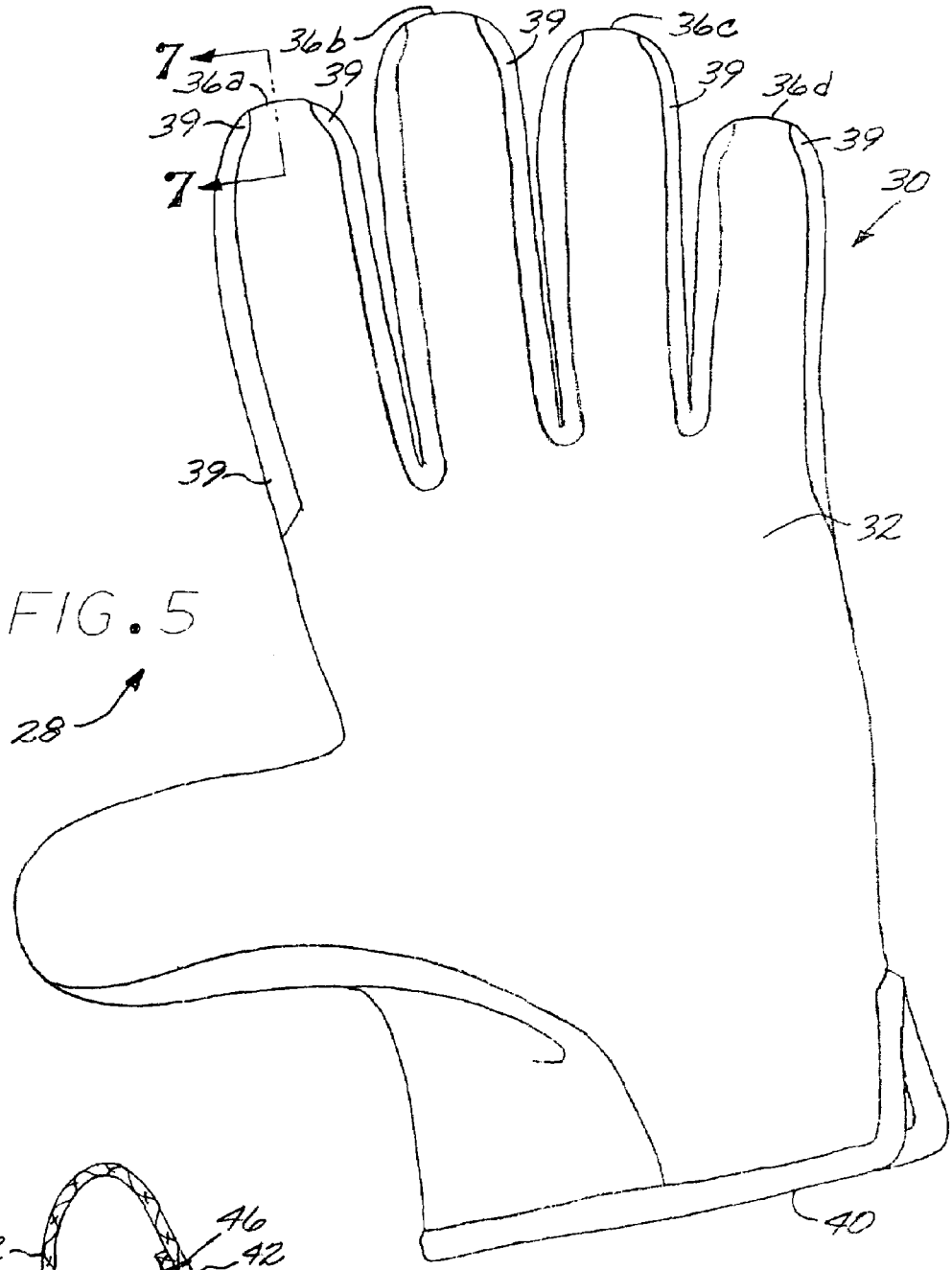
FIG. 5 is a view of the palm portion of a glove configuration of the present invention.
Figure 7:
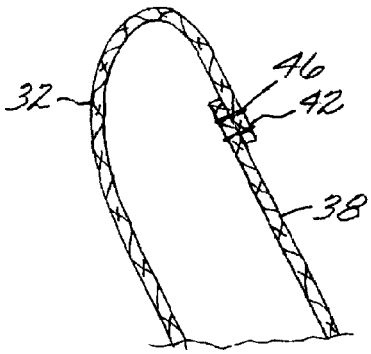
FIG. 7 is a sectional view along line 7-7 of FIG. 5.
Figure 7A:
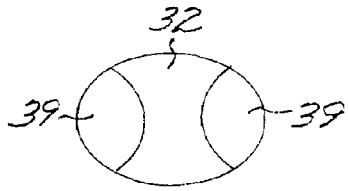
FIG. 7A is a top view of a glove fingertip.
Figure 6:
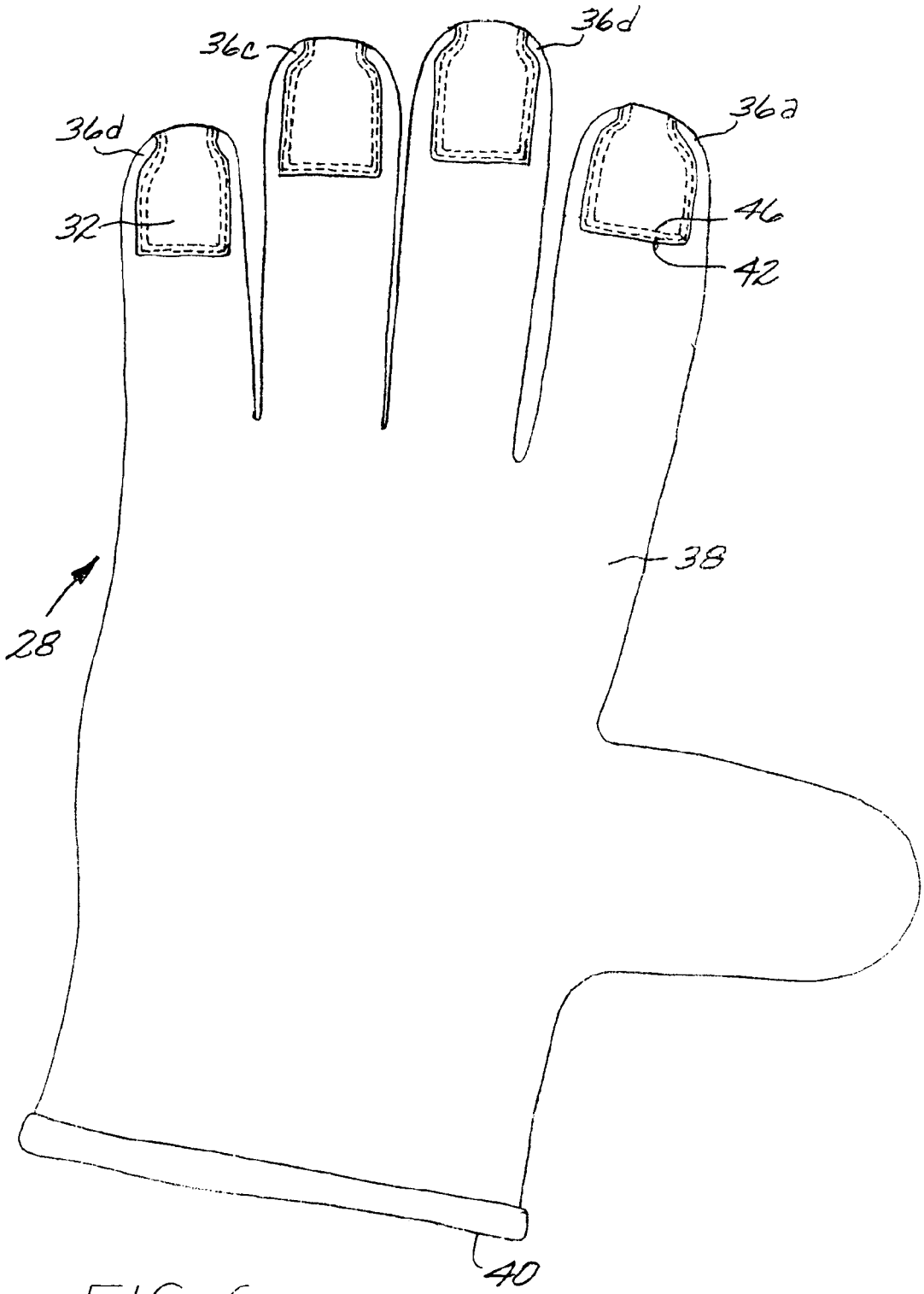
FIG. 6 is a view of the back piece portion of the glove configuration shown in FIG. 5.

Referring now to FIGS. 5, 6 and 7, the palm piece 30 and back piece 38 of a first embodiment of the glove construction of the present invention is illustrated. Palm piece 30 comprises material 32, preferably made of a synthetic suede material such as Amara, an opening 40 in the base of glove 28 to allow a wearer to insert his/her hand therein and index finger 36*a*, middle finger 36*b*, ring finger 36*c* and a pinkie finger 36*d*. The palm material 32 varies in width as it rolls over the distal end of each finger (fingertip) onto the back of the finger and is secured to the back piece 38 of glove 28 at a position spaced from the distal end of the finger by stitches 42 and 46. In particular, the shape of material 32 narrows as it goes over the fingertip and preferably has the shape of an hourglass with the narrowest part being at the top of the fingertip (FIG. 7A). The narrowing shape provided by the fourchettes 39 forces the glove fingers to be rounded on the sides which in turn causes the glove fingers to have a shape in the form of a wearer's finger/fingertip. In essence, separate strips of material forming at least one side of each finger portion is joined both to the glove back means along the length of each finger portion and joined to the love palm means along the length of each finger.

It should be noted that although only the stitching for the index finger 36*a* has been illustrated, the same stitching pattern is also utilized for the other fingers.

Figure 8:
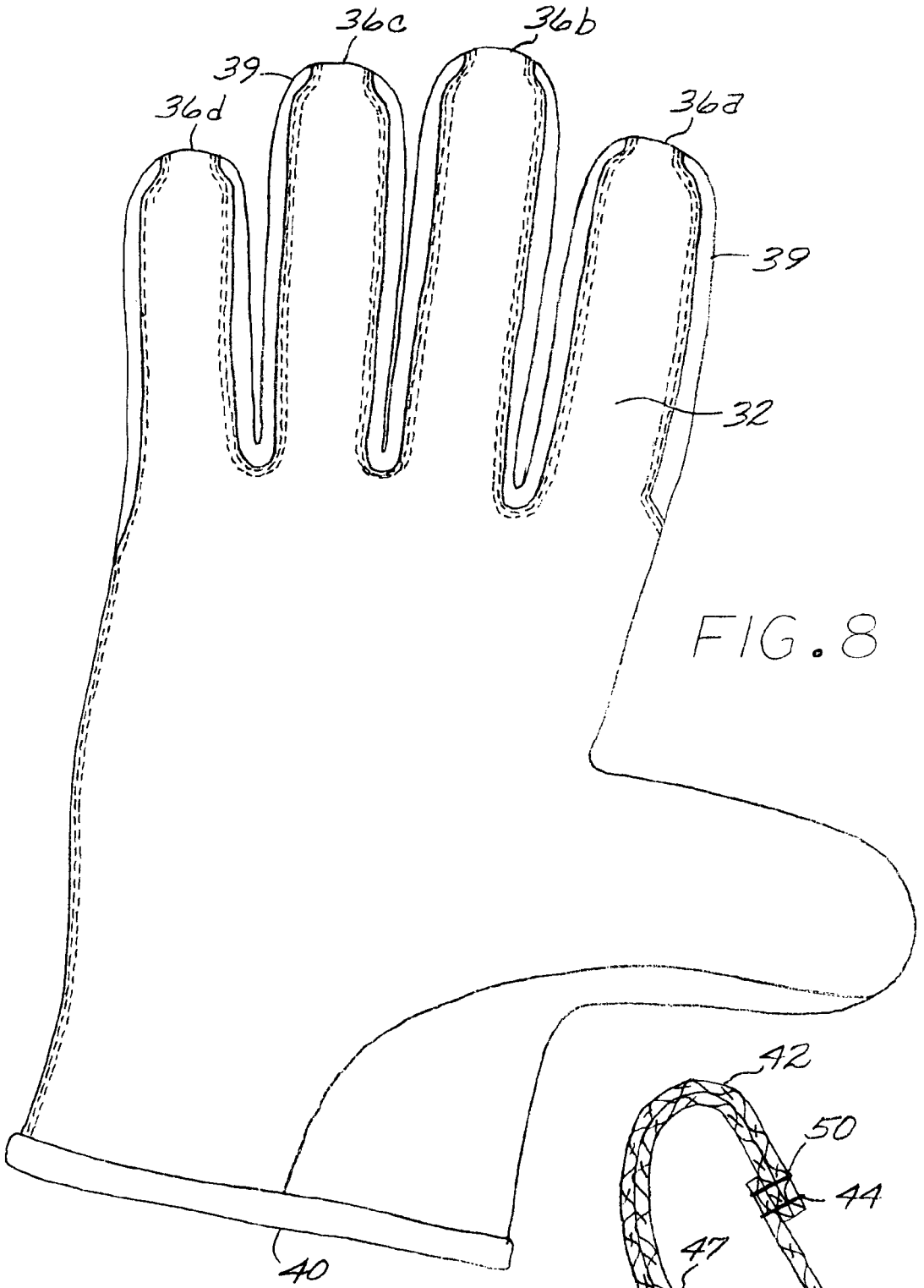
FIG. 8 is a view of the glove configuration of FIG. 5 turned inside out.
Figure 9:
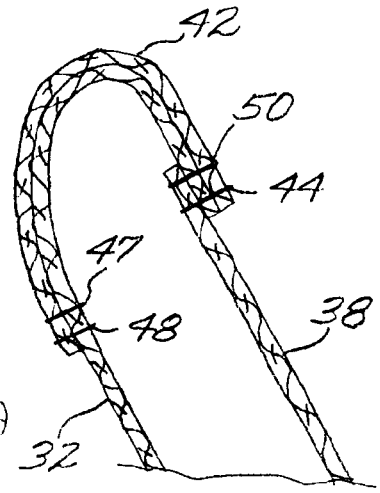
FIG. 9 illustrates a further glove configuration wherein the roll over fingertip is reinforced.

FIG. 8 shows the glove of FIG. 5 inside out and FIG. 9 illustrates how the palm piece 32 is sewn (stitched) to the back piece 38. Back piece 38 is preferably made of a flexible, stretchable material such as ribbed spandex.

FIG. 9 is illustrative of a technique for reinforcing the roll over fingertips. In particular, a reinforcement material 42, such as synthetic suede or Duraclad, a registered mark of Ironclad Performance Wear Corp., Los Angeles, Calif. for a PVC fabric and rubber coated fabric used in the manufacture of gloves, rolls over the fingertip, crossing the back piece on the top of the finger. Reinforcement material 42 is sewn to the palm material 32 at stitches 47 and 48. Thereafter, reinforcement material 42 and palm material 32 are stitched to back piece 38 at stitches 44 and 50.

To place the invention in perspective, description of the assembly of a typical prior art glove and the roll over glove as set forth herein follows.

In a conventional glove assembly, the stitching is on the inside of the glove, assembly thus being initiated inside out.

1. A glove palm is first cut from a roll of material (additional material pieces may be added);

2. A glove back is cut/assembled from materials;

3. Fourcettes (sides of fingers) are stitched to the glove back (at this point, each fourcette is stitched to the glove back along one side of the fourcette, leaving the other side free);

4. The glove palm is then stitched to the fourchettes, along their free sides, bringing the two halves together. A continuous stitch line may be employed to join all of the fingers of the palm to all of the fourcettes. As this stitch line passes around the end of each finger, it joins the glove palm material and back material together with a seam at the fingertip (these stitches occur in a flat plane, none of the turns in the stitch line making a tight 180° turn);

5. The remainder of the glove palm and back (areas other than the fingers) are stitched together.

6. The glove is turned right-side out. The seams at the fingertips are thus pointed inward.

The roll-over finger tip assembly of the present invention is as follows (since all stitching is on the inside of the glove, assembly occurs with the glove inside out):

1. A glove palm is cut from a roll of material (additional material pieces may be added); the design of the palm material being such that the lengths of the finger portions are significantly longer than the finger portions of the glove back material;

2. A glove back is cut/assembled from materials;

3. The glove palm and back materials are stitched together at the end of their respective finger portions. The materials join with an overlapping seam that does not point inward when the glove is turned right-side out. Because the glove palm finger lengths are longer than the glove back finger lengths, the eventual location of the fingertip will contain palm material only. The overlapping seam will be located on or behind the fingernail, laying flat against the skin.

4. A single fourcette is stitched to the palm material along one side of a finger portion. The stitch begins at the crotch of the finger. When the stitch reaches the fingertip, a sharp 180° turn is made and proceeds along the other side of the fourcette, and continues on to stitch together the same fourcette to a finger portion of the glove back material, towards the crotch of the finger. In this fashion, the stitch has gone from the plane of the glove palm to the plane of the glove back, and has reversed directions;

5. The remaining fourcettes are stitched to the palm and back materials in the same fashion, one at a time.

6. The remainder of the glove palm and back (areas other than the fingers) are stitched together;

7. The glove is turned right-side out.

As a result of this fabrication technique, there are no horizontal seams at the fingertips, avoiding the disadvantages of the conventional glove fabrication as noted hereinabove.

The main differences that result in the two procedures are summarized as follows:

In the conventional glove fabrication (1), all fourcettes are stitched to the finger portions of the glove back in one step, along one side of each fourcette; (2) all fourcettes are stitched to the glove palm in one step, typically with a single stitch line; (3) the glove palm and back materials meet at the fingertips; (4) an inward-pointing seam is formed at the fingertips; and all stitching remains in the same plane.

In the rollover design the of present invention, (1) fourcettes are attached to the glove one at a time, first to the palm material along one side and then to the back material along the other side of the same fourcette; (2) glove palm and back materials meet on the top of the finger, at or behind the fingernail, there being no seam at the fingertip; (3) the seam at the fingernail is an overlapping seam, in which the materials lay flat against each other and do not point inward; (4) when transitioning from one side of a fourcette to the other, the stitching makes a tight 180° turn into a different plane, a novel assembly step; and (5) an optional hourglass-shaped fingertip enhances the three dimensional shape of the fingertip.

The present invention thus provides an improved glove construction wherein the glove fingertips are designed to have a shape that conforms to the shape of the wearer's fingertips and wherein the conventional seam at the end of the fingertips is eliminated.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A glove construction comprising:

glove back means having first and second surfaces and formed in the shape of a human hand having fingers for forming a portion of the back of the glove, said glove back means having fingers portions;

glove palm means having first and second surfaces and formed in the shape of a human hand for forming a portion of the palm of the glove; said glove palm means comprising palm material having integral pieces which form finger portions, said glove back means and said glove palm means forming a portion of the glove when joined together, said integral pieces extending over at least one of said fingertips, said extended pieces having an hourglass shape and means for securing said extended piece at a predetermined distance from said fingertip, said extended integral piece comprising a first portion having a first width at a position spaced from said fingertip on said glove palm means, a second portion having a second width, less than said first width, at said fingertip and a third portion having a third width substantially equal to said first width, at a position spaced from said fingertip on said glove back means;

separate strips of material, forming at least one side of each finger portion, joined to said glove back means along the length of each finger portion and joined to said glove palm means along the length of each finger portion; and an opening for receiving the hand of a wearer, the hand of the wearer being in contact with the first surface of said glove back means and the first surface of said glove palm means.

2. The glove construction of claim 1 wherein said glove back means and said glove palm means each have inner surfaces, wherein the hand of the wearer contacting said inner surfaces of said glove back means and glove palm means when inserted into said opening.

3. A glove construction comprising:

glove back means having first and second surfaces and formed in the shape of a human hand having fingers for forming a portion of the back of the glove, said glove back means having fingers portions;

glove palm means having first and second surfaces and formed in the shape of a human hand for forming a portion of the palm of the glove; said glove palm means comprising palm material having integral pieces which form finger portions, said glove back means and said glove palm means forming a portion of the glove when joined together, said integral pieces extending over at least one of said fingertips, said extended pieces having an hourglass shape, said hourglass shape having first and second portions of a first width and a third portion between said first and second portions of a second width, said second width being less than said first width;

separate strips of material, forming at least one side of each finger portion, joined to said glove back means along the length of each finger portion and joined to said glove palm means along the length of each finger portion;

an opening for receiving the hand of a wearer; and means for securing said extended integral piece to said glove back means, the hand of the wearer being in contact with the first surface of said glove back means and the first surface of said glove palm means.

* * * * *